US007152439B1

(12) United States Patent
Chang

(10) Patent No.: US 7,152,439 B1
(45) Date of Patent: Dec. 26, 2006

(54) PADLOCK

(75) Inventor: Chin-Shu Chang, Changhua (TW)

(73) Assignees: Vulcan Sports Co., Ltd., Changhua (TW); Chien-Yuan Hsu, Changhua (TW)

( * ) Notice: Subject to any disclaimer, the term of this patent is extended or adjusted under 35 U.S.C. 154(b) by 0 days.

(21) Appl. No.: 11/344,172

(22) Filed: Feb. 1, 2006

(51) Int. Cl.
*E05B 37/06* (2006.01)

(52) U.S. Cl. ..... 70/30; 70/18; 70/21; 70/53; 70/312; 24/134 R; 24/134 P

(58) Field of Classification Search ..... 70/14, 70/18, 19, 21, 22, 24–30, 39, 49, 53, 57, 70/64, 65, 68, 312; D8/330, 331, 333; 24/132 R, 24/115 R, 132 KA, 134 R, 134 P, 134 L, 24/134 KB
See application file for complete search history.

(56) References Cited

U.S. PATENT DOCUMENTS

| | | | | | |
|---|---|---|---|---|---|
| 432,539 | A * | 7/1890 | Mains | 24/134 KB |
| 539,650 | A * | 5/1895 | Searle | 70/16 |
| 558,814 | A * | 4/1896 | Hunt | 70/49 |
| 1,257,040 | A * | 2/1918 | Steuernagel | 269/204 |
| 1,331,778 | A * | 2/1920 | Michell | 70/49 |
| 1,475,256 | A * | 11/1923 | Belair | 70/18 |
| 1,512,589 | A * | 10/1924 | Freysinger | 70/39 |
| 1,530,177 | A * | 3/1925 | Heyer | 70/39 |
| 2,190,661 | A * | 2/1940 | Hauer | 70/49 |
| 2,508,302 | A * | 5/1950 | Stue | 70/19 |
| 2,637,884 | A * | 5/1953 | Morehouse | 24/336 |
| 3,841,118 | A * | 10/1974 | Stone | 70/33 |
| 3,897,161 | A * | 7/1975 | Reinwall, Jr. | 403/211 |
| 3,965,544 | A * | 6/1976 | Boden | 24/136 R |
| 5,193,368 | A * | 3/1993 | Ling | 70/30 |
| 5,435,044 | A * | 7/1995 | Ida | 24/136 R |
| 5,791,170 | A * | 8/1998 | Officer | 70/49 |
| 6,189,348 | B1 * | 2/2001 | Huang | 70/18 |
| 6,363,758 | B1 * | 4/2002 | Ling | 70/30 |
| 6,470,718 | B1 * | 10/2002 | Yang | 70/30 |
| 6,526,785 | B1 * | 3/2003 | Asenstorfer et al. | 70/49 |
| 6,609,399 | B1 * | 8/2003 | Daniels, Jr. | 70/49 |
| 6,629,440 | B1 * | 10/2003 | Meekma et al. | 70/49 |
| 6,997,023 | B1 * | 2/2006 | Huang | 70/21 |
| 7,047,772 | B1 * | 5/2006 | Yu | 70/21 |
| 2005/0092037 | A1 * | 5/2005 | Meekma et al. | 70/30 |

* cited by examiner

*Primary Examiner*—Suzanne Dino Barrett
(74) *Attorney, Agent, or Firm*—Troxell Law Office, PLLC

(57) ABSTRACT

An improved padlock and particular an improved small padlock that has a shackle adjustable to a desired length includes a lock body and a steel cable. The steel cable can run through the lock body to form a closed shackle. The lock body includes a casing, a dial assembly, two pushbuttons, two thrust members and two latch members. Locking and unlocking operations can be accomplished by depressing the pushbuttons. The latch members can engage with the steel cable to form a locking condition, or be moved away from the steel cable to form a unlocking condition so that the shackle range formed by the steel cable and the lock body can be adjusted to meet user's requirements. It overcomes the problem of the conventional padlocks that provide a shackle which is not adjustable and often does not have an adequate length.

4 Claims, 4 Drawing Sheets

PADLOCK

BACKGROUND OF THE INVENTION

1. Field of the Invention

The invention relates to a padlock and particularly to an improved small padlock with a shackle adjustable to a desired length.

2. Description of the Prior Art

The conventional small padlock, whether with a rigid shackle or a flexible steel cable for the shackle, usually has a constant length. For instance, R.O.C. patent No. 93214130 discloses padlock with a steel cable. The steel cable has one end fastened to one side of a lock casing and a free end on other end insertable into a latch trough and a first inlet/outlet. The lock casing contains a first lock mechanism to control locking and unlocking to allow the steel cable to form a closed condition with the lock body to provide locking function. In the locking condition, the free end has to be positioned on a fixed location. The shackle range between the steel cable and the lock body depends on the length of the steel cable and is constant. As the small padlock has a small size and a limited distance, in the event that two or more goods have to be locked at the same time, or the size of the goods to be locked is larger, the shackle cannot provide enough holding space, then an extra lock has to be used for locking. It costs more to buy another lock, also wastes more time to do locking and unlocking. It creates problems in use. Using the steel cable of a greater length to remedy this problem results in too big of the shackle range that makes locking less effective.

SUMMARY OF THE INVENTION

In view of the aforesaid problems occurred to the conventional padlock such as one end being fixed and another free end to be latched on a trough and a first inlet/outlet to provide a constant shackle range and the length of the shackle range cannot be adjusted to suit user's requirement, thus has limited applicability. The present invention aims to provide a solution to overcome these problems.

The primary object of the invention is to provide a padlock that has a shackle adjustable to a desired length. Its structure mainly includes a lock body and a steel cable. The lock body has two through latch holes to be run through by two ends of the steel cable to couple with the lock body to form a closed shackle. The lock body includes a casing, a dial assembly, two pushbuttons, two thrust members and two latch members. The casing includes a upper casing and a lower casing that have coupling struts and coupling holes on corresponding sides to couple together, and a holding portion in the interior to hold the dial assembly, a first strut to couple with the two latch members and a torsional spring, and a second strut to couple with each thrust member. The steel cable runs through the two latch holes. The lock body has a housing trough on each of two sides to hold each pushbutton. The housing trough also has a guiding trough running through the interior to hold the guiding track of the pushbutton to control swiveling of the thrust member. Thereby the latch member can be driven so that a gear rack formed on one end thereof can be extended in the latch hole to engage with the steel cable to form a locking condition, or moved away from the latch hole to separate from the steel cable to form a unlocking condition. Meanwhile, the length of the steel cable can be adjusted to form an optimum shackle.

By means of the construction set forth above, the shackle range can be adjusted any time according to user's requirements to suit varying applications. Hence it can lock one or more pieces of goods in an optimum condition and overcome the shortcomings of the conventional small padlocks.

The foregoing, as well as additional objects, features and advantages of the invention will be more readily apparent from the following detailed description, which proceeds with reference to the accompanying drawings.

DESCRIPTION OF THE PREFERRED EMBODIMENTS

Figures 1, 2:
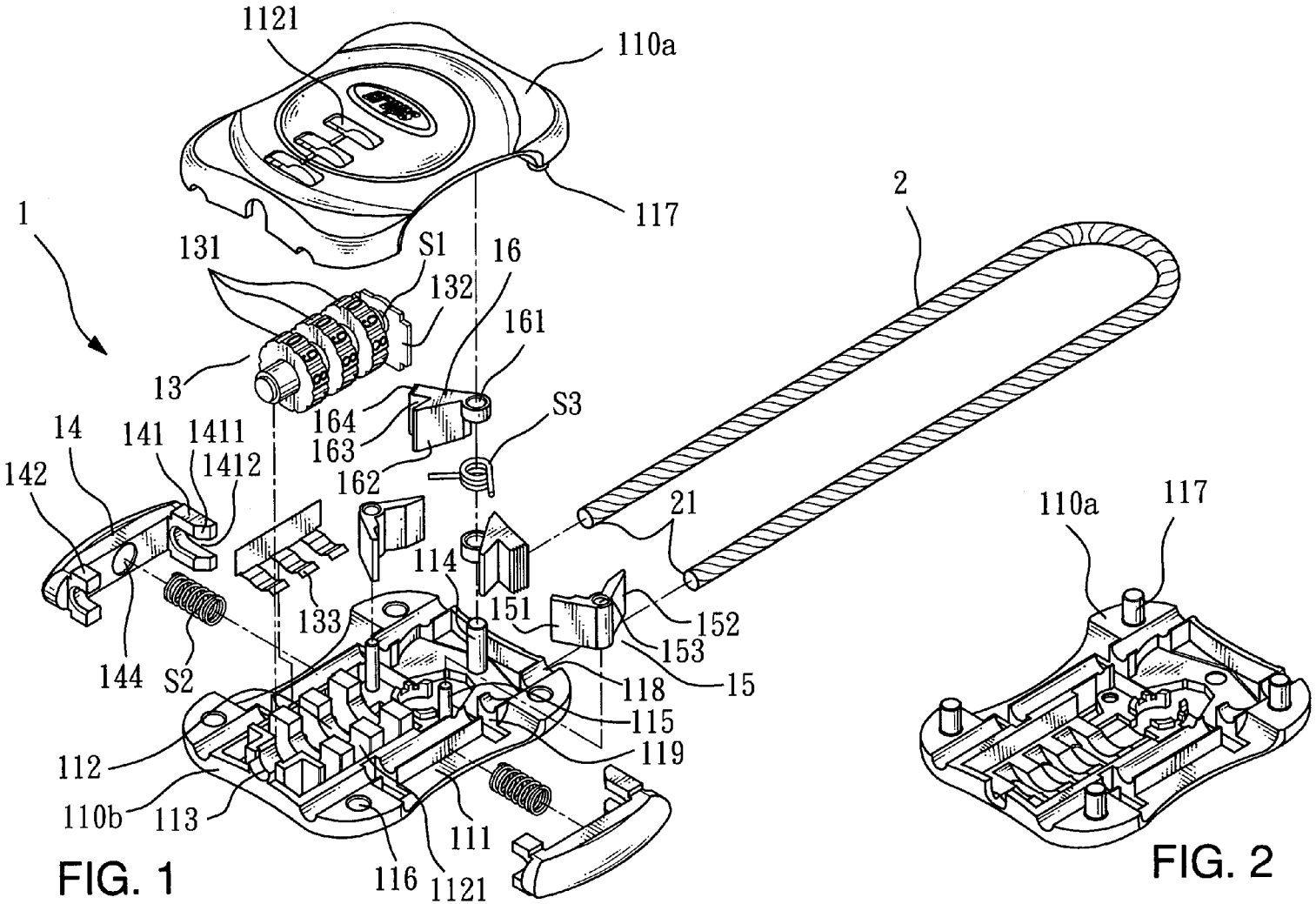
FIG. 1 is an exploded view of the invention.
FIG. 2 is a perspective view of the inner side of a upper casing of the invention.
Figure 3:
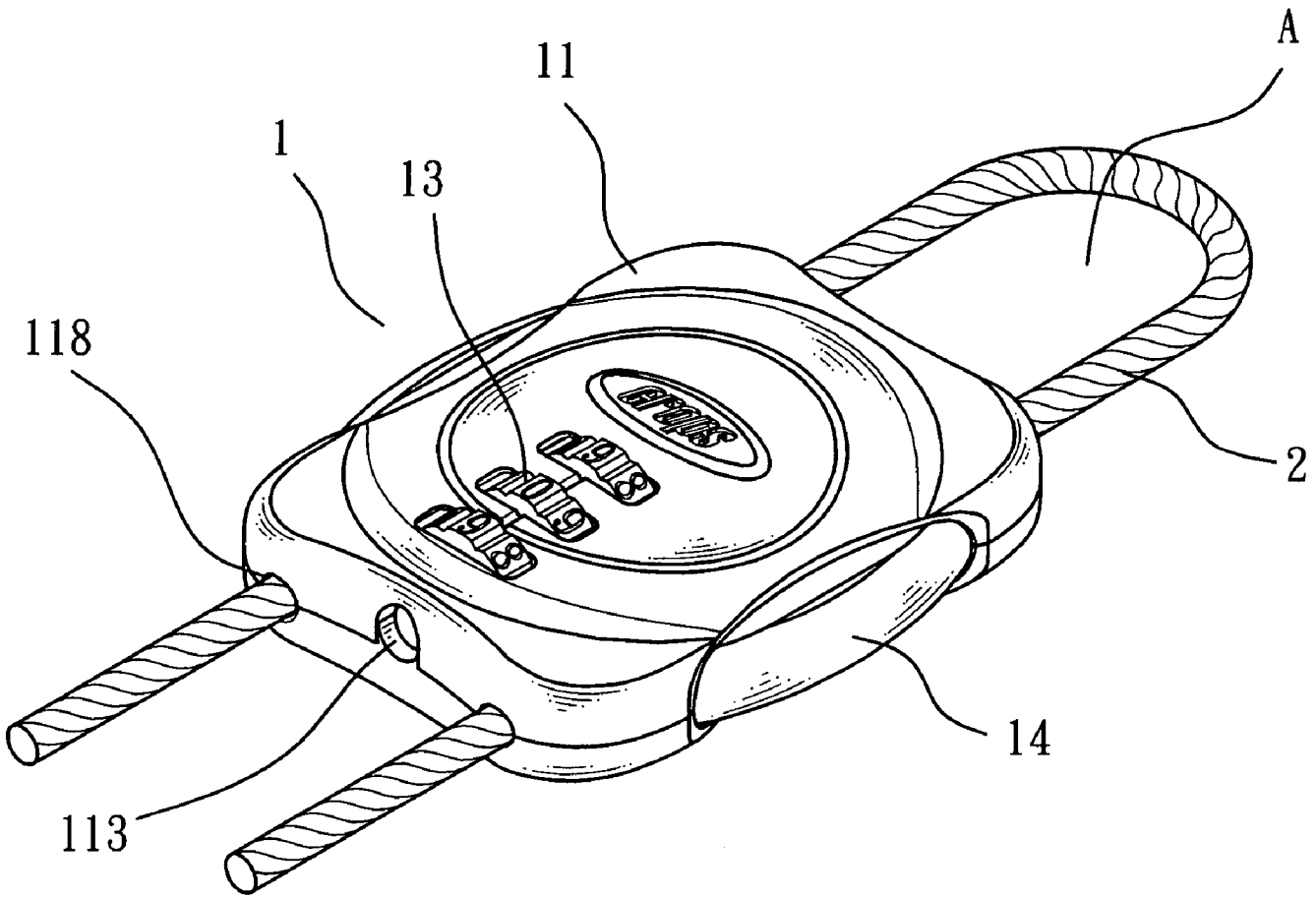
FIG. 3 is a perspective view of the invention in an assembled condition.

Referring to FIGS. 1, 2 and 3, the padlock according to the invention includes a lock body 1 and a steel cable 2. The steel cable 2 is flexible and has two ends 21 insertable through the lock body 1 to form a close shackle A. The lock body 1 includes a casing 11, a dial assembly 13, two pushbuttons 14, two thrust members 15 and two latch members 16.

The casing 11 has a upper casing 110*a* and a lower casing 110*b* corresponding to each other, and a housing trough 111 on each of two sides. The housing trough 111 contains a guiding trough 119 running through the interior thereof and a holding portion 112 in the center, and an aperture 113 of a smaller diameter running through one end thereof. The holding portion 112 has a plurality of slots 1121 on one side, and a first strut 114 on another end, and two second struts 115 close to two sides thereof. The lower casing 110*b* has a plurality of coupling cavities 116 near the periphery to be coupled with coupling struts 117 of the upper casing 110*a*. The casing 11 further has two latch holes 118 on one end to be run through by the two ends 21 of the steel cables 2.

The dial assembly 13 is located in the holding portion 112 and includes a numeral wheel set 131 and a thrust plate 132. The numeral wheel set 131 has one peripheral side exposed through the slots 1121. The thrust plate 132 can be moved radially under the control of the numeral wheel set 131 and a spring S1. The numeral wheel set 131 can be rotated under the control of an elastic reed 133 to a correct numeric combination, then the thrust plate 132 is moved by the elastic force of the spring S1.

The pushbuttons 14 are located in the housing troughs 111 of the casing 11 opposing each other. Each of the pushbuttons has a first guiding arm 141 and a second guiding arm 142 that are vertically extended from two sides. The first guiding arm 141 has a sloped surface 1411 on an inner side of one end and a notch 1412 to be passed through by the steel cable 2. Each pushbutton 14 further has a round cavity 144 in the center to hold a compression spring S2. Through the elastic force of the compression spring S2 the pushbutton 14 is movable in the housing trough 111.

The thrust member 15 is a V-shaped element and has a round hole 153 to couple with the second strut 115, and a first side plate 151 and a second side plate 152 on two sides. The first side plate 151 presses the thrust plate 132 of the dial assembly 13.

The latch member 16 has another round hole 161 to couple with the first strut 114 and a notch 163 to receive the second side plate 152 of the thrust member 15 and be pushed to swivel. It has a gear rack 164 on an outer end to engage with the steel cable 2. The two latch members 16 are interposed by a torsional spring S3 and engaged therewith. The torsional spring S3 has two legs pressing respectively an inner side surface 162 of the latch members 16. The torsional spring S3 provides an extending elastic force to move the gear rack 164 in the latch hole 118 of the casing 11.

Figure 4:
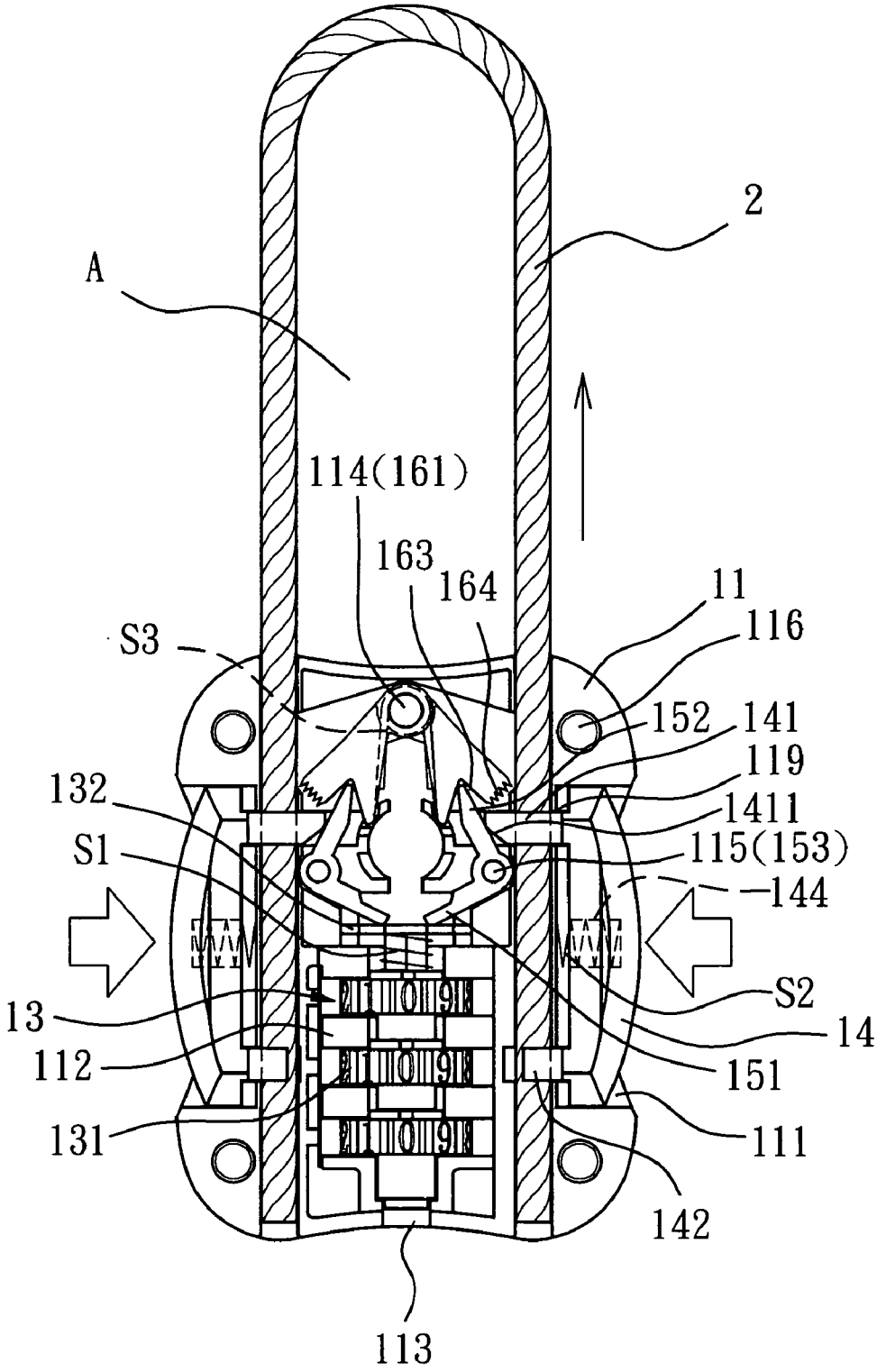
FIG. 4 is a schematic view of the invention in a unlocking operation.
Figure 5:
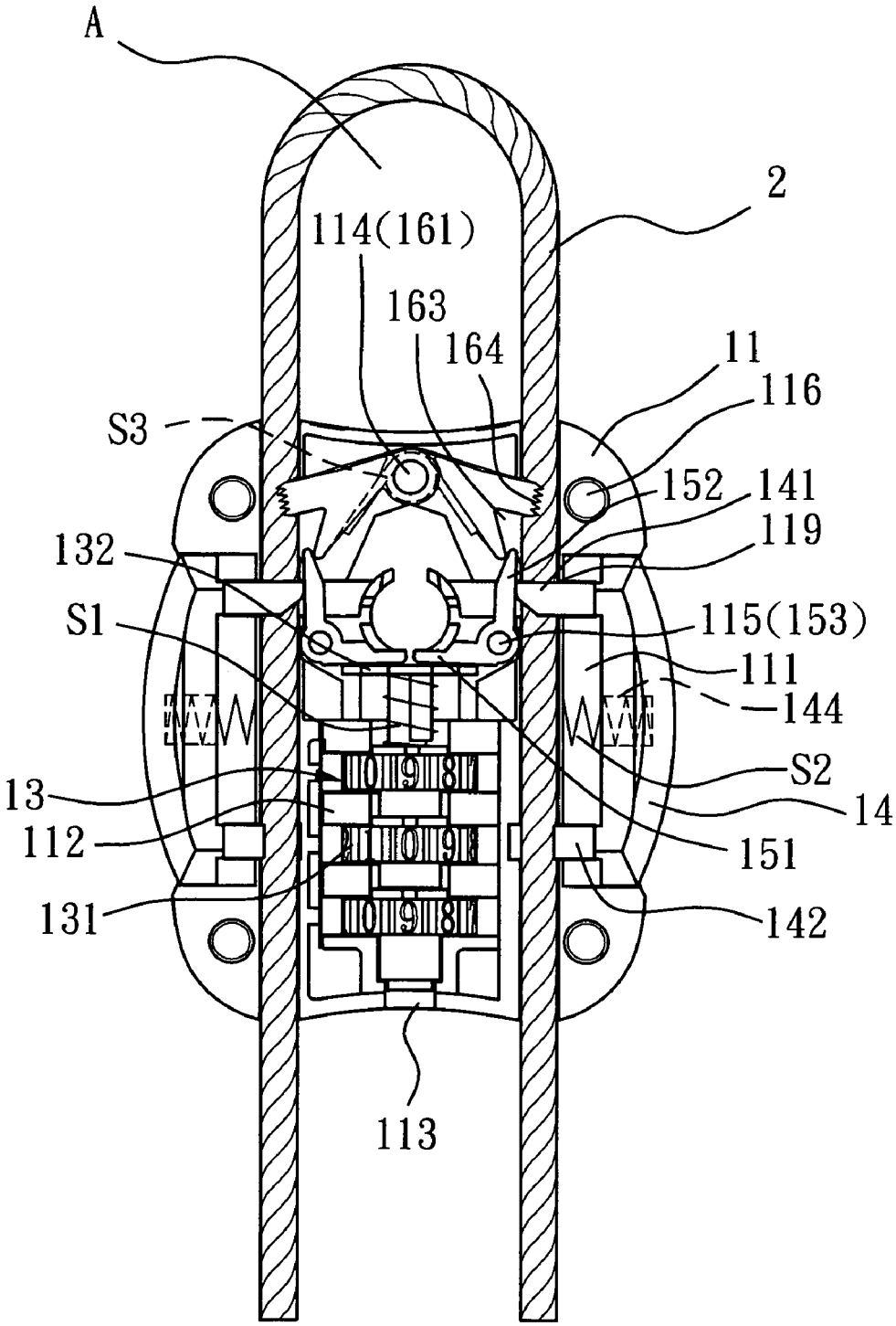
FIG. 5 is a schematic view of the invention in a locking condition.

Refer to FIG. 4 for the invention in a unlocking condition. First, turn the numeral wheel set 131 of the dial assembly 13 to the correct numeric combination, and the thrust plate 132 is in a movable condition. Depress the pushbuttons 14 on the two sides of the casing 11, the first guiding arm 141 and second guiding arm 142 are moved inwards along the guiding trough 119 to push the second side plate 152 of the thrust member 15; the thrust member 15 turns about the second strut 115 to drive the latch member 16 so that the gear rack 164 is moved away from the latch hole 118; then the steel cable 2 can run through the latch holes 118 to allow the shackle A to be adjusted to a required length. Then release the pushbuttons 14. The compression spring S2 returns to the normal position and condition under the returning elastic force. The thrust member 15 is not pushed by the first guiding arm 141 and the second guiding arm 142. The latch member 16 is pushed by the extending force of the torsional spring S3, hence the gear rack 164 on the outer side engages tightly with the steel cable 2 so that the steel cable 2 cannot be pulled out. Then move the numeral wheel set 131 randomly so that the thrust plate 132 cannot be moved, and presses the first side plate 151. The thrust member 15 is anchored and cannot be swiveled. As a result, the pushbuttons 14 also cannot depressed to form a locking condition (referring to FIG. 5).

I claim:

1. An improved padlock comprising a lock body and a steel cable; the steel cable being flexible and having two ends running through the lock body to form a closed shackle, the lock body including a casing, a dial assembly, two pushbuttons, two thrust members and two latch members; wherein:

the casing has a upper casing and a lower casing corresponding to each other, a holding portion in the center, and a housing trough on each of two sides thereof; the housing trough containing a guiding trough running through the interior thereof, the casing having two latch holes on one end to be run through by the steel cables;

the dial assembly is located in the holding portion and includes a numeral wheel set and a thrust plate, the numeral wheel set being turnable to a correct numeric combination to allow the thrust plate to be moved radially;

the pushbuttons are located in the housing troughs of the casing opposing each other and have respectively a first guiding arm and a second guiding arm vertically extended from two sides and movable in the guiding trough, and a cavity on an inner side to hold a compression spring which provides an elastic force to allow the pushbuttons to be movable in the housing trough;

each of the thrust members is a V-shaped element and has a first side plate and a second side plate, the first side plate pressing the thrust plate of the dial assembly; and the latch members have respectively a notch to receive the second side plate of the thrust member and be pushed to swivel, and a gear rack on an outer end to engage with the steel cable, the two latch members being interposed by a torsional spring and engaged therewith, the torsional spring having two legs pressing respectively an inner side surface of the latch members to provide an extending elastic force to move the gear rack in the latch hole of the casing.

2. The improved padlock of claim 1, wherein the lower casing has a plurality of coupling cavities close to the periphery to be coupled with corresponding coupling struts located on the upper casing.

3. The improved padlock of claim 1, wherein the first guiding arm has a sloped surface on an inner side of one end thereof.

4. The improved padlock of claim 1, wherein the first guiding arm has a notch to be passed through by the steel cable.

* * * * *